United States Patent [19]

Martin, Jr.

[11] Patent Number: 4,653,287

[45] Date of Patent: Mar. 31, 1987

[54] SYSTEM FOR HEATING AND COOLING LIQUIDS

[76] Inventor: James B. Martin, Jr., P.O. Box Drawer X, Deerfield Beach, Fla. 33441

[21] Appl. No.: 787,142

[22] Filed: Oct. 15, 1985

Related U.S. Application Data

[63] Continuation of Ser. No. 695,541, Jan. 28, 1985, abandoned.

[51] Int. Cl.[4] ..... F25D 17/00

[52] U.S. Cl. ..... 62/181; 62/235.1; 62/238.6; 62/238.7; 62/325; 237/2 B

[58] Field of Search ..... 62/325, 238.6, 238.7, 62/235.1, 180, 181; 237/2 B

[56] References Cited

U.S. PATENT DOCUMENTS

| | | | |
|---|---|---|---|
| 3,513,663 | 5/1970 | Martin, Jr. et al. | 62/238.6 X |
| 3,992,896 | 11/1976 | Janson et al. | 62/238.6 |
| 4,248,056 | 2/1981 | Beacham | 62/238.7 |
| 4,249,390 | 2/1981 | Jones | 62/238.7 |
| 4,254,630 | 3/1981 | Geary | 62/238.6 X |
| 4,327,561 | 5/1982 | McNeal et al. | 62/238.6 X |
| 4,363,218 | 12/1982 | Nussbaum | 62/238.6 X |
| 4,479,365 | 10/1984 | Holmes | 62/238.6 |
| 4,492,091 | 1/1985 | Whitwell et al. | 62/238.6 X |

*Primary Examiner*—Lloyd L. King

*Attorney, Agent, or Firm*—Charles J. Prescott

[57] ABSTRACT

Improvements in the system for heating and cooling liquids as disclosed in prior U.S. Pat. No. 3,513,663. This prior system utilizes components of refrigeration such as a compressor, a condenser coil, an evaporator coil, a refrigerant, and expansion valve, in their well-known interrelationship and includes a first and second liquid source, which are pumped in heat-exchange fashion through segregated condenser and evaporator coils simultaneously with, and in the opposite direction to, that of the refrigerant. One broad improvement embodies the elimination of the second liquid source, typically a ground water well, and to alter normal liquid flow to achieve either heating or cooling. Another broad aspect of this invention is to optionally alter the path of both first and second liquid source flows in segregated heat-exchange fashion through the condenser and evaporator coils, whereby heating or cooling of either liquid source may be easily selected and controlled. Refrigerant flow may also be altered. Yet another embodiment is to provide a source of external fluid flow over either condenser or evaporator coil to increase system efficiency related to either heating or cooling of either or both liquid sources. These improvements may be incorporated into the prior art system separately, or in any combination, to provide unique and novel benefits, depending upon situational and/or economic restraints.

23 Claims, 8 Drawing Figures

SYSTEM FOR HEATING AND COOLING LIQUIDS

This is a continuation application of originally filed application Ser. No. 695,541 filed Jan. 28, 1985, now abandoned.

BACKGROUND OF THE INVENTION

This invention relates generally to the heating and cooling of liquids, and more particularly, to the improvements in a compression-type refrigeration system for heating and cooling liquids such as water in a swimming pool.

In the past, many systems have been employed to heat water which utilize resistive-type electric heating elements, or relied upon the combustion of either natural gas or fossil fuel. The former system is well-known to be highly inefficient; the latter system, in addition to also being inefficient, includes the short-comings attendant to combustion, i.e., exhaust gases, a needed source of fuel, high temperature water conduit corrosion, and operational hazards.

A more recent development is disclosed in U.S. Pat. No. 3,513,663, of which applicant was co-inventor. In its broadest sense, this invention teaches te use of conventional refrigeration components, with modification, to heat a first liquid source, e.g., a swimming pool, while simultaneously cooling a second liquid source, e.g., a ground well. Preferably coaxial conduit is utilized in the construction of condenser and evaporator coils for the purpose of achieving opposing, segregated, heat exchange flow between refrigerant and liquid. In operation, when one liquid source is passed through the condenser coil while the second liquid source is passed through the evaporator coil, coaxial, opposing, segregated refrigerant liquid flow in seriatum through the coils will result in efficient heating of the first liquid, while cooling the second liquid. Sensor control and liquid pumping means are also disclosed therein.

The present invention contemplates improvements over the above-disclosed U.S. Patent. One aspect of these improvements includes the elimination of the second or ground liquid source. Another aspect of these improvements comprises liquid and/or refrigerant flow reversal or rerouting to conveniently heat or cool one liquid source. And finally, this invention discloses select use of external fluid flow over condenser or evaporator coils to enhance the coefficient of performance.

BRIEF SUMMARY OF THE INVENTION

The present invention discloses and claims certain improvements in a system for heating a first liquid source which utilizes a refrigeration compressor, a condenser coil, an evaporator coil, a refrigerant, and means for expansion of the compressed refrigerant, all in their well-known interconnected manner, and which also includes a second liquid source. These improvements may be incorporated separately, or in combination, to provide novel benefits in relation to the situational and/or economic restraints.

One such improvement broadly deals with the elimination of the second liquid energy source, which has typically been a ground water well. In areas of the country where ground water is scarce or where there is no other convenient source of heat, this improvement, then, provides liquid source heating or cooling at higher operational efficiencies than previously available. Liquid source heating occurs by extracting heat from the source liquid flow as needed at one point in the refrigerant cycle, then adding substantially greater amounts of heat at another point in the refrigerant cycle. By this means, the liquid source acts as a net resultant heat sink, becoming progressively warmer.

Another broad aspect of the present invention is to optionally alter the path of both first and second liquid source flows in segregated heat exchange fashion through the condenser and evaporator coils. This reversal provides easily controlled and varied heating or cooling of either liquid source.

And still another broad aspect of the present inventive improvement is to provide a source of external fluid flow over either condenser or evaporator coil to achieve increased efficiency of either heating or cooling of either or both liquid sources.

It is therefore an object of this invention to provide improvements in the system for heating and cooling liquids disclosed in U.S. Pat. No. 3,513,663.

It is another object of the above invention to provide optional heating or cooling of either liquid source.

It is yet another object of this invention to eliminate the need for the second liquid source.

It is still another object of this invention to improve performance efficiency for either heating or cooling by the select forced flow of external fluid over specific refrigeration components.

In accordance with these and other objects which will become apparent hereinafter, the instant invention will now be described with reference to the accompanying drawings in which:

DETAILED DESCRIPTION OF THE PREFERRED EMBODIMENT

Figures 1, 2, 3:
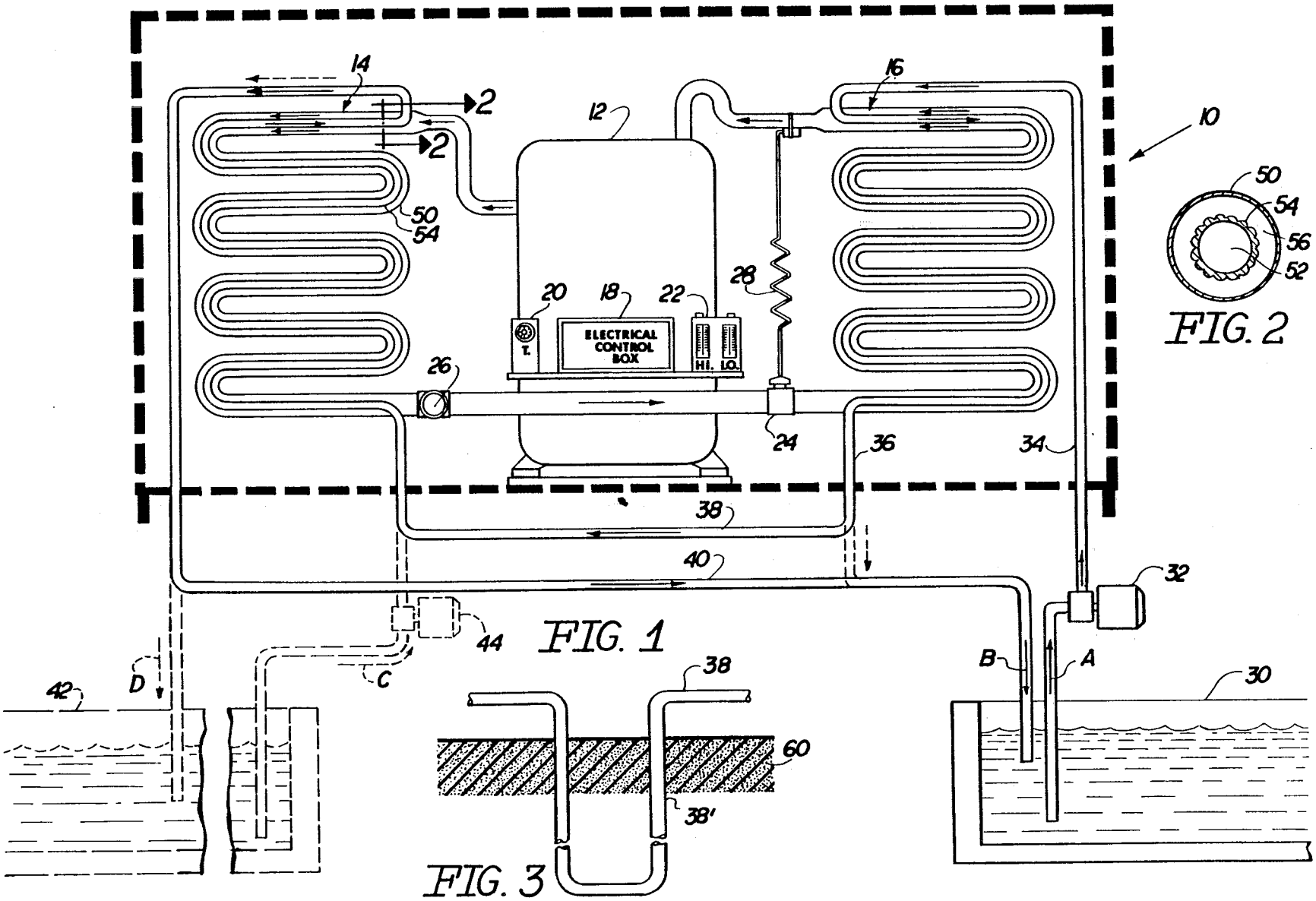
FIG. 1 is a schematic view of the first embodiment of the invention.
FIG. 2 is a section view through arrows 2—2 in FIG. 1.
FIG. 3 is a schematic view of another embodiment of the present invention.

Referring now to the drawings, and particularly to FIGS. 1 and 2, one embodiment of the improved system is shown generally at 10, and includes a refrigeration compressor 12, a condenser coil 14, and an evaporator coil 16 in their normal refrigeration cycle relationship. Heated, compressed refrigerant passes out of the compressor 12 into the condenser 14, where it is to be cooled. Thereafter, the refrigerant is passed through means for refrigerant expansion 24 and into the evaporator coil 16, where heat is absorbed during vaporization change of state. This vapor is then suctioned back into the compressor 12, the cycle continuously repeated. Sight glass 26 provides visual indication of adequate refrigerant charge. Electrical control box 18, thermostat control 20, and high/low pressure control switch 22 are interconnected between compressor and a power source (not shown) to regulate operation in a well-known manner.

In FIG. 2 is shown a coaxial coil conduit, preferred and typical of both compressor coil 14 and evaporator coil 16, which preferably are of similar construction and design. Note that any other convenient conduit design for coil and evaporator may be incorporated which allows liquid and refrigerant to flow in a side-by-side heat exchange manner. Refrigerant flows in passage 56 within outer conduit 50 and around inner conduit 54. Liquid pumped by pump 32 from a second liquid reservoir 30 in the direction of arrow A and returned in the direction of arrow B, flows through inner conduit 54 in heat exchange relationship to the refrigerant flowing in the opposite direction through the evaporation coil 16 and compressor coil 14 as indicated by the arrows. In the embodiment of this invention, shown in FIG. 1, the first liquid reservoir 42 and pump 44 are eliminated and liquid flowing from evaporator coil 16 discharge conduit 36 is re-routed via transfer conduit 38 also through the condenser coil 14 and back to the second reservoir 30 via return conduit 40.

The net result of the arrangement shown in FIG. 1 is to heat the liquid in liquid reservoir 30, which may be a swimming pool, hot water storage tank or any other source of liquid which is intended to be heated. As the liquid passes through evaporator coil 16, the vaporizing refrigerant absorbs heat from the liquid, which discharges through conduit 36 at a temperature Y degress cooler than its inlet temperature X degrees. However, the liquid then passes through condenser coil 14, during which time it absorbs heat from the just-compressed refrigerant. The liquid discharges from the condenser coil 14 at a temperature approximtely 2 Y degree warmer than its condenser inlet temperature, X degrees minus Y degrees. The liquid returning to the second liquid reservoir 30 is therefore at a temperature of X degrees plus Y degrees, or Y degrees warmer than when it was pumped out in the direction of arrow A. This net heating effect may be explained by virtue of the compressor 12 converting electrical power into heat by compression of the refrigerant, the converted source of energy for this system. This energy conversion and adsorption is at a considerably higher level of efficiency than either resistive heating elements or fuel combustion. And the need for first liquid reservoir 42, typically ground water, is eliminated in geographic areas where it is unavailable.

Referring to FIG. 3, to add further heat to the liquid returning to the second liquid source 30, a portion 38' of the transfer conduit 38 may be rotated through any convenient additional heat source, preferably partially embedded in the ground 60 sufficiently deep to be warmer than the liquid discharging from the evaporator coil, X degrees minus Y degrees. Alternately, this section of conduit 38' may be routed through a solar panel for passive heat absorption.

Figure 4:
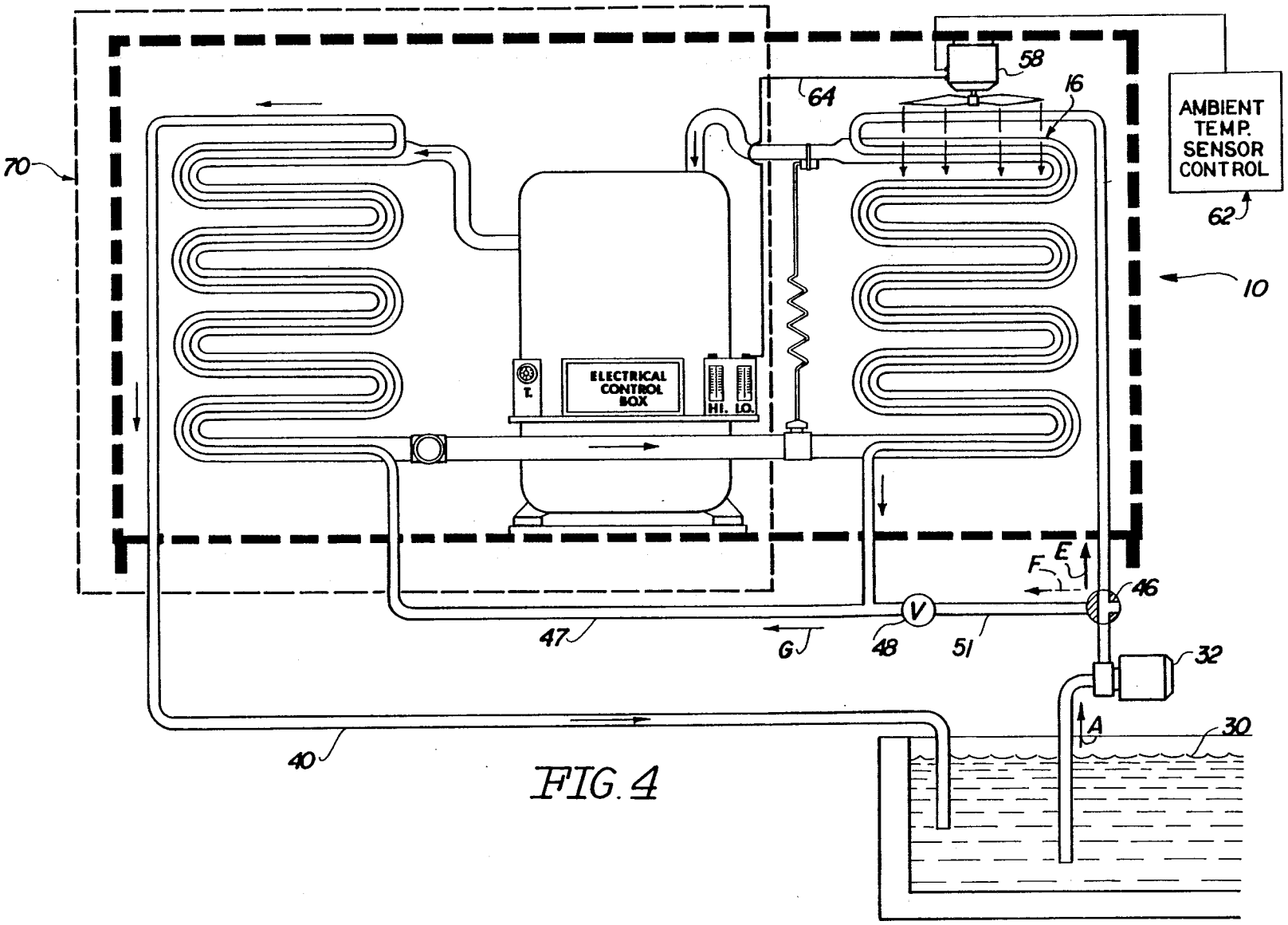
FIG. 4 is a schematic view of yet another embodiment of the present invention.

Referring to FIG. 4, the boxed portion 70 remains the same as that previously described, as does the construction of the evaporator coil 16. Likewise, only the second liquid reservoir 30 is utilized. However, in this embodiment the output liquid flow A may be partially or totally diverted in the direction of arrow F through bypass conduit 51 by a 0% to 100% proportional three-way regulating valve 46. The evaporator coil 16 requires a certain amount of heat to prevent "icing," but as the liquid and/or the ambient air temperature rises, the liquid flow requirement decreases to provide that heat. Thus, either all, or a portion E of the pump 32 total output flow passes through the evaporator coil 16, or all or a portion F of the total flow bypasses the evaporator coil 16. The position of regulating valve 46 is regulated by the sensed pressure within the evaporator coil 16 and associated electrical controls (not shown). Check valve 48 prevents backflow in bypass conduit 51. All liquid flow is returned to the second reservoir 30 via conduit 40. By this means, the heating effect upon the second liquid reservoir 30, flowing through transfer conduit 47 in the direction of arrow G, is maximized by minimizing the degree to which the liquid flow is passed through, and cooled by, the evaporator coil 16.

Still referring to FIG. 4, to further maximize this heating benefit, a fan 58 may also, or alternatively to liquid bypass, be provided which forces ambient air over the evaporator coil 16. The operation of this fan 58 is regulated by both an ambient temperature sensor control 62 as well as an electrical signal connection 64 to the refrigerant low pressure sensor within the evaporator coil 16. Thus, when both ambient air temperature is sufficiently high, and evapoartor refrigerant pressure is sufficiently low, more external heat is provided to the refrigerant vaporizing within the evaporator coil 16, and thus, more liquid is able to be diverted in the direction of arrow F. In sum, then, where only a single source of liquid is available or utilized, dual or separate evaporator coil 16 heating may be provided by controlled proportional liquid flow bypass and/or external fluid flow over the evaporator coil 16, which external fluid may be ambient air or, as will be described below, a second, separate external liquid flow.

Figure 5:
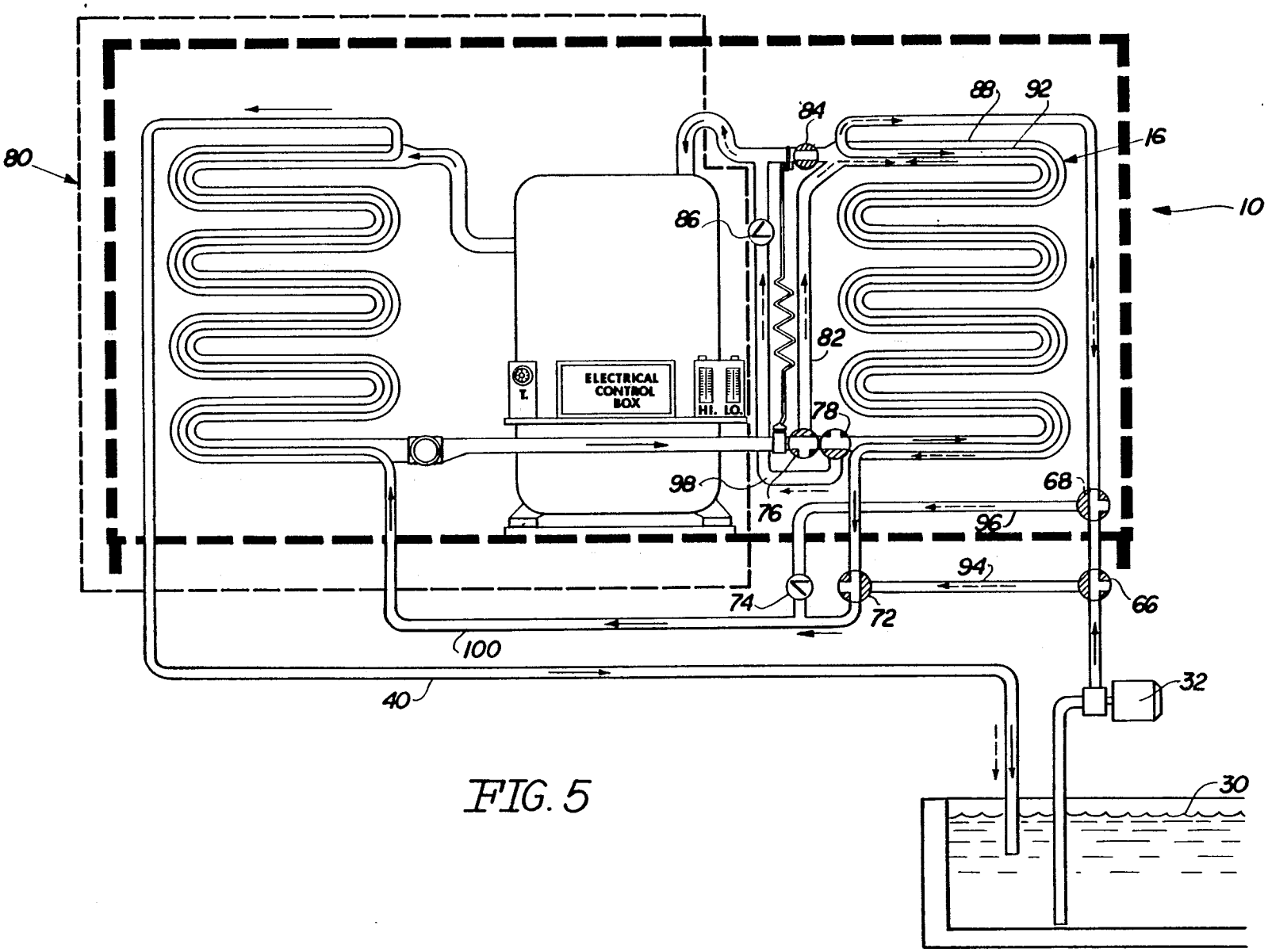
FIG. 5 is a schematic view of still another embodiment of the present invention.

Referring now to FIG. 5, the boxed portion 80 remains the same as in FIG. 1, as does the construction of the evaporator coil 16. In the prior art system as well as that in FIG. 1, the flow of the refrigerant through both evaporator and condenser coils 14 and 16 is opposite to that of the liquid flow. This is so to maximize the heat exchange relationship within the coaxial coil conduit best previously shown in FIG. 2. However, in this alternate embodiment shown in FIG. 5, also intended to maximize heating of the second liquid reservoir 30, and also where the first liquid reservoir 42 is eliminated, the flow of refrigerant and liquid optionally is in the same direction. By this means, the temperture gradient between refrigerant and liquid at any point within the evaporator coil 16 is minimized and, therefore, the cooling effect upon the liquid is also minimized. To accomplish this optional, controlled flow reversal, either the liquid flow is reversed, shown by dotted arrows, or the refrigerant flow is reversed, shown by dotted arrows. The liquid flow reversal is accomplished by three-way valve 66 first diverting the flow to three-way valve 72, then into, through, and out of, the evaporator coil 16 via conduit 88 to three-way valve 68, through check valve 74, and into transfer conduit 100. The refrigerant flow reversal is accomplished by three-way valve 76, first diverting the expanding, vaporizing refrigerant through conduit 82 into the opposite end 88 of the evaporator coil 16, and back out to three-way valve 78, where the refrigerant is carried via conduit 98 through check valve 86 into the compressor. Shut-off valve 84 prevents refrigerant from either flowing from conduit 82 directly back into the compressor or flowing from conduit 98 back into the evaporator coil 16 at 88. Either flow reversal is controlled and made intermittent, and is reversed back, when the low pressure sensor within the evaporator coil signals insufficient refrigerant vapor pressure.

Figure 6:
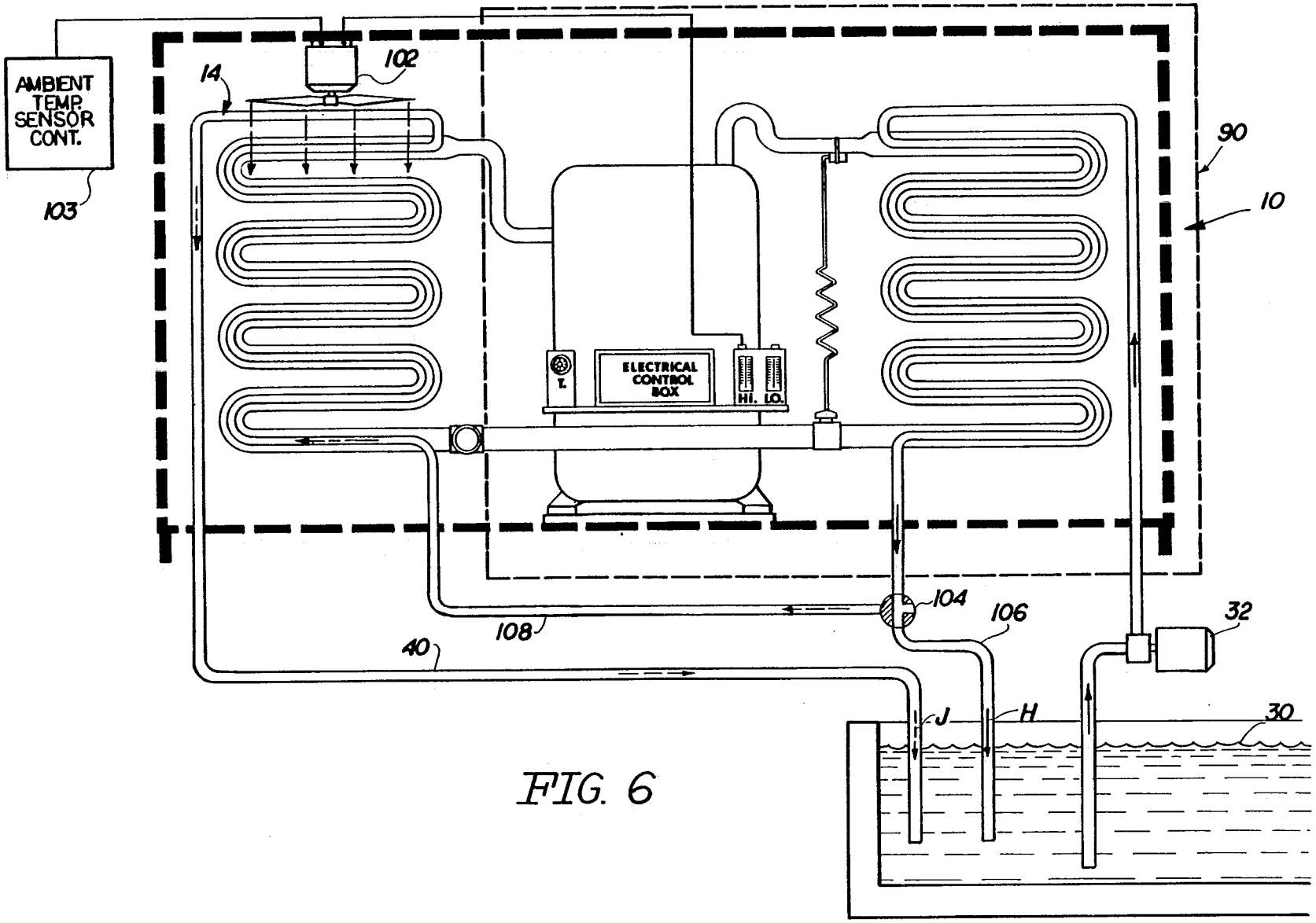
FIG. 6 is a schematic view of yet another embodiment of the present invention.

Referring now to FIG. 6, the components within the boxed area 90 remain as in FIG. 1, and the first liquid reservoir is eliminated. However, this embodiment is intended to optionally also cool the second liquid reservoir 30 by totally or partially diverting the liquid flow as it exits the evaporator coil 16 back to the reservoir. By this means, the liquid heating effect imposed by the condensor coil 14 is eliminated. This is accomplished by proportional three-way valve 104, which controlledly returns liquid directly to the reservoir by return conduit 106 in the direction of arrow H. To enhance this liquid cooling effect by prolonging this liquid diversion, fan 102 may be provided to force ambient air across the condenser coil 14. This will at least partially cool the condenser coil 14, depending upon ambient air temperature as sensed at 103, which will shut-off fan 102 if ambient air cannot cool the coil 14. Bypass liquid flow will cease and valve 104 will reroute liquid flow into the condenser coil 14 and/or the system will be shut down when condenser coil 14 pressure rises above a predetermined upper limit. Note that, in this arrangement as described in FIG. 4, the external condenser cooling fluid may be ambient air and/or another fluid such as water.

Figure 7:
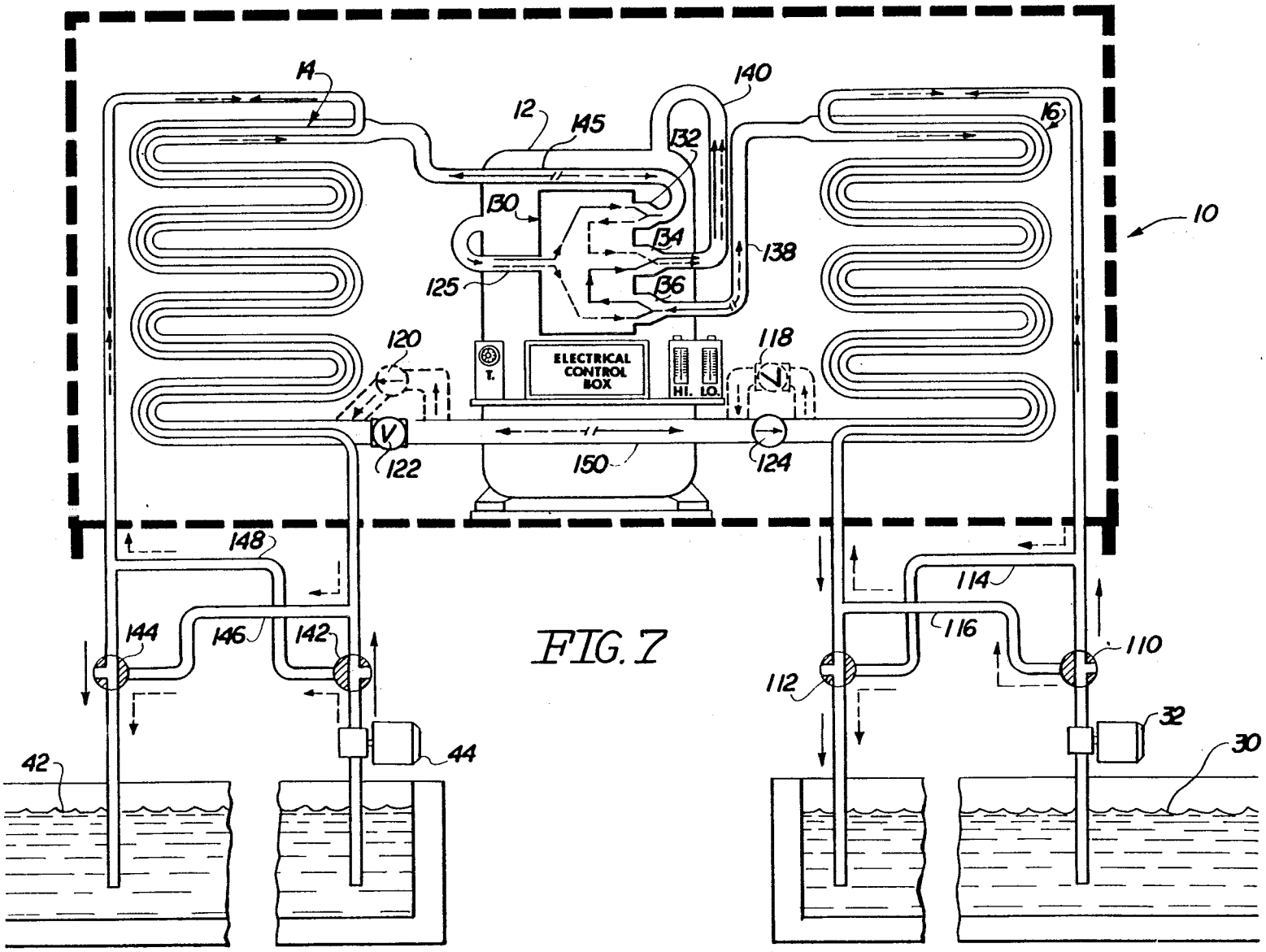
FIG. 7 is a schematic view of still another embodiment of the present invention.

In FIG. 7, both liquid reservoir 30 an 42 are intended to be utilized, wherein either reservoir may be either heated or cooled, the temperature of the other reservoir being changed oppositely. To accomplish this selective heating or cooling of a particular reservoir, the liquid flow from the pumps 32 and 44 are made reversible within each coil 14 and 16 simultaneously with refrigerant flow reversal coil to coil. In normal operation and as disclosed in prior U.S. Pat. No. 3,513,663, liquid flow from the first liquid reservoir 42, typically a swimming pool, via pump 44 (shown in solid arrows) is directed through condenser coil 14 and returned to the reservoir 42 somewhat heated, while liquid flow from a second reservoir 30, typically ground water, via pump 32 (shown in solid arrows) is directed through evaporator coil 16 and returned to the second reservoir 30 somewhat cooled while refrigerant routing is as in FIG. 1, including the dotted portion. However, for example, to cool the first liquid reservoir 42, e.g., a swimming pool, a liquid flow from pump 44 is diverted at three-way valves 142 and 144 and thus made to flow oppositely through condenser coil 14 in the direction of the dotted arrows through crossover conduits 146 and 148. Likewise, liquid flow from pump 32 is diverted at three-way valves 110 and 112, and thus made to flow oppositely through evaporator coil 16 in the direction of the dotted arrows through crossover conduits 114 and 116. Simultaneously, refrigerant reversing valve 130, such as that available from Alco Controls, No. 401 RD Series Reversing Valves, receiving compressor 12 refrigerant output through conduit 125, selectively diverts refrigerant from its normal path (shown by solid arrows), which is through valve port 132 into valve port 136. Thus, the diverted refrigerant flow (shown by dotted arrows) passes first out of valve port 136, then into the evaporator coil 16 via conduit 138, then through condenser coil 14 and back to the compressor 12 through conduit 145, into valve port 132, exiting valve port 134. By this means, the evaporator coil 16 acts as a condenser and the condenser coil 14 acts as an evaporator, heating the second reservoir 30 and cooling first reservoir 42. Bypass check valve 118 and bypass expansion valve 120 facilitates refrigerant flow only in the direction of the dotted arrows, check valve 122 and expansion valve 124 only allowing refrigerant flow in the direction of the solid arrows. Refrigerant return flow to the compressor 12 is through conduit 140, fed by normal refrigerant flow from conduit 138 into valve port 136 and exiting valve port 134, and in reverse mode, fed by conduit 145 into valve portion 132 and exiting valve port 134. Note that the selective heating or cooling is achieved without co-mingling the two liquid reservoirs 30 and 42, a very desirable situation.

Figure 8:
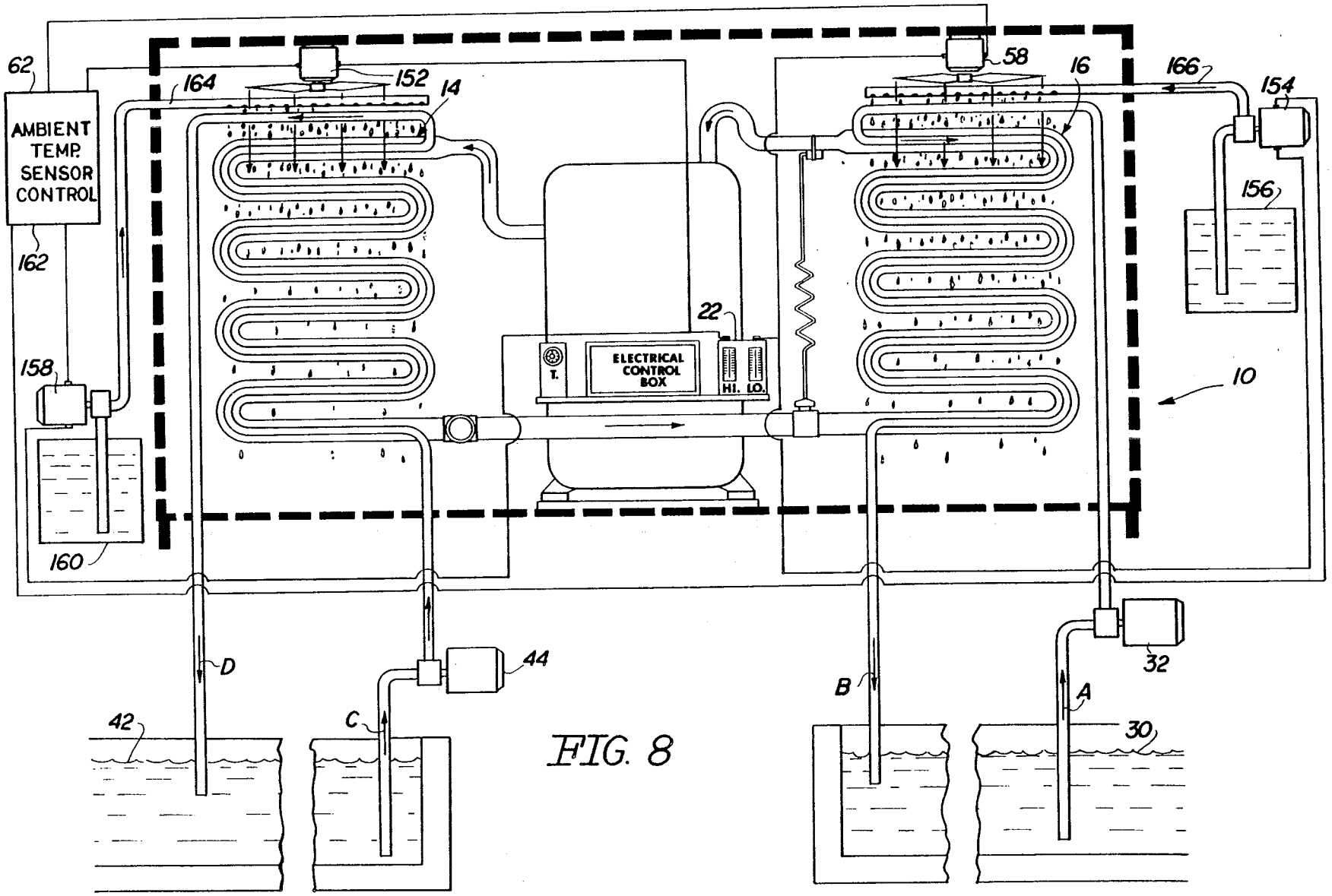
FIG. 8 is a schematic view of yet another embodiment of the present invention.

Referring now to FIG. 8, the overall system 10' is similar to that in FIG. 1, except also having a first liquid reservoir 42 in said fluid communication with the condenser coil 14. The point of novelty in this embodiment 10' is the selective addition of a second external source of liquid for heating the evaporator coil 16 or cooling the condenser coil 14. This external fluid flow may be provided over the coils 14 and 16 by fans 152 and 58 respectively, forcing air flow shown by the arrows, or by fluid flow discharge from apertured conduits 164 and 166 supplied by pumps 158 and 154 respectively, in fluid communication with reservoirs 160 and 156 respectively. Return drainage (not shown) to these reservoirs 156 and 160 may also be provided or the fluids may be wasted. When cooler fluid is passed over the external surface of the condenser coil 14, the system energy efficiency ratio (E.E.R.) of the system 10' is increased. When warmer fluid is passed over the external surface of the evaporator coil 16, the system coefficient of performance (C.O.P.) is increased. External fluid flow is regulated by the combination of control signals from the ambient temperature sensor control 162 and the high/low refrigerant pressure sensor 22.

Note that, in an alternative, and perhaps broader, sense within the scope of this invention; either coil may alternately be submerged within a portion of the liquid reservoir or its liquid flow therefrom and back. This coil submersion will still provide a substantial amount of necessary coil heating or cooling and desired liquid cooling or heating. However, the necessity for coaxial or equivalent coil conduit construction would be eliminated.

While the instant invention has been shown and described herein in what is conceived to be the most practical and preferred embodiment, it is recognized that departures may be made therefrom within the scope of the invention, which is therefore not to be limited to the details disclosed herein but is to be accorded the full scope of the claims so as to embrace any and all equivalent apparatus and articles.

What is claimed is:

1. A system for heating and cooling liquid comprising:

a first and second conduit means for conveying a first and second liquid therein respectively, substantially in fluid isolation one to another;

a source of refrigerant;

a refrigerant compressor having an inlet and an outlet, said compressor for compressing and heating said refrigerant and then discharging said heated and compressed refrigerant out said compressor outlet;

a condenser coil and an evaporator coil each having first and second segregated, adjacent fluid passages each having an inlet and an outlet;

said condenser coil first passage inlet for receiving said compressed, heated refrigerant from said compressor outlet, said compressed and heated refrigerant then passing through said condenser coil first passage and out said condenser coil first passage outlet;

said first conduit means conveying the first liquid into said condenser coil second passage inlet and through said condenser coil second passage in opposing heat exchange relationship to said heated and compressed refrigerant flowing through said condenser coil first passage whereby the first liquid is heated and said refrigerant and said condenser coil are cooled;

said first conduit means also conveying the heated first liquid exiting from said condenser coil second passage outlet;

first one-way means for predetermined, controlled metering of said compressed and cooled refrigerant discharging from said condenser coil first passage outlet into said evaporator coil first passage inlet whereby said refrigerant is vaporized and cooled at lower pressure within said evaporator coil first passage;

means for returning said refrigerant from said evaporator coil first passage outlet back to said compressor through said compressor inlet;

said second conduit means for conveying the second liquid into said evaporator coil second passage inlet and through said evaporator coil second passage in opposing heat exchange relationship to said vaporized and cooled refrigerant flowing through said evaporator coil first passage whereby the second liquid is cooled and said refrigerant and said evaporator coil are heated;

said second conduit means also conveying the cooled second liquid exiting from said evaporator coil second passage outlet;

refrigerant flow reversing means for controlled re-routing of said compressed and heated refrigerant discharging from said compressor outlet in seriatim first into said evaporator coil first passage outlet, then through said evaporator coil first passage whereby the second liquid flowing through said evaporator second passage is heated, then out said evaporator coil first passage inlet and through a second one-way means for predetermined metering of said compressed and cooled refrigerant, then into said condenser coil first passage outlet, then through said condenser coil first passage whereby the first liquid flowing through said condenser coil second passage is cooled, then out said condenser coil first passage inlet and then returning back to said compressor inlet.

2. A system for heating and cooling liquids as set forth in claim 1, further comprising:

first liquid flow reversing means for controlled re-routing of the first liquid conveyed into said condenser coil second passage outlet, through said condenser coil second passage, out said condenser coil second passage inlet, and out of said first conduit means;

second liquid flow reversing means for controlled, re-routing of the second liquid conveyed into said evaporator coil second passage outlet, through said evaporator coil second passage, out said evaporator coil second passage inlet and out of said second conduit means;

said refrigerant flow reversing means and said first and second liquid flow reversing means controlled in a predetermined manner one to another.

3. A system for cooling liquids as set forth in claim 1, wherein:

said first conduit means is connected to a liquid storage tank having a replenished supply of water therein for use;

said second conduit means is connected to a circulating water supply tower having water therein.

4. A system for cooling liquids comprising:

first and second conduit means for conveying a first and second liquid therein respectfully, substantially in fluid isolation one to another;

a source of refrigerant;

a refrigerant compressor having an inlet and an outlet, said compressor for compressing and heating said refrigerant and then discharging said heated and compressed refrigerant out of said compressor outlet;

a condenser coil and an evaporator coil each having first and second segregated, adjacent fluid passages each having an inlet and an outlet;

said condenser coil first passage inlet for receiving said compressed, heated refrigerant from said compressor outlet, said compressed and heated refrigerant then passing through said condenser coil first passage and out said condenser coil first passage outlet;

said first conduit means conveying the first liquid into said condenser coil second passage inlet and through said condenser coil second passage in opposing heat exchange relationship to said heated and compressed refrigerant flowing through said condenser coil first passage whereby the first liquid is heated and said refrigerant and said condenser coil are cooled;

said first conduit means also conveying the heated first liquid exiting from said condenser coil second passage outlet;

first one-way means for predetermined, controlled metering of said compressed and cooled refrigerant discharging from said condenser coil first passage outlet into said evaporator coil frist passage inlet whereby said refrigerant is vaporized and cooled at lower pressure within said evaporator coil first passage;

means for returning said refrigerant from said evaporator coil first passage outlet back to said compressor through said compressor inlet;

said second conduit means for conveying the second liquid into said evaporator coil second passage inlet and through said evaporator coil second passage in opposing heat exchange relationship to said vaporized and cooled refrigerant flowing through said evaporator coil first passage whereby the second liquid is cooled and said refrigerant and said evaporator coil are heated;

said second conduit means also conveying the cooled second liquid exiting from said evaporator coil second passage outlet;

a source of fluid;

controlled means for pumping said fluid over the exterior surface of said condenser coil when said fluid temperature is cooler than said condenser coil.

5. A system for cooling liquids as set forth in claim 4, wherein:

said fluid is air.

6. A system for cooling liquids as set forth in claim 4, wherein:

said fluid is water.

7. A system for cooling liquids as set forth in claim 1, wherein:

said first conduit means is connected to a swimming pool having water therein;

said second conduit means is connected to a ground water aquifer having water therein.

8. A system for heating a liquid comprising:

conduit means for conveying a liquid;

a source of refrigerant;

a refrigerant compressor having an inlet and an outlet, said compressor for compressing and heating said refrigerant and then discharging said heated and compressed refrigerant out said compressor outlet;

a condenser coil and an evaporator coil each having first and second segregated, adjacent fluid passages each having an inlet and an outlet;

said condenser coil first passage inlet for receiving said compressed, heated refrigerant from said compressor outlet, said compressed and heated refrigerant then passing through said condenser coil first passage and out said condenser coil first passage outlet;

one-way means for predetermined, controlled metering of said compressed and cooled refrigerant discharging from said condenser coil first passage outlet into said evaporator coil first passage inlet whereby said refrigerant is vaporized and cooled at lower pressure within said evaporator coil first passage;

means for returning said refrigerant back to said compressor through said compressor inlet;

said conduit means conveying the liquid into said evaporator second passage inlet and through said evaporator coil second passage in opposing heat exchange relationship to said vaporized and cooled refrigerant flowing through said evaporator coil first passage whereby the liquid is cooled and said vaporized refrigerant and said evaporator coil are heated;

said conduit means also conveying the liquid exiting from said evaporator coil second passage outlet into said condenser coil second passage inlet, through said condenser coil second passage in opposing heat exchange relationship to said heated and compressed refrigerant flowing through said condenser coil first passage whereby the liquid is heated and said refrigerant and said condenser coil are cooled;

said conduit means also conveying the heated liquid exiting from said condenser second passage outlet.

9. A system for heating a liquid as set forth in claim 8, further comprising:

conduit means for conveying the liquid through a passive heat sink having a temperature greater than that of the liquid exiting from said evaporator coil second passage outlet and before entering said condenser coil second passage inlet.

10. A system for heating a liquid as set forth in claim 9, wherein:

said heat sink is the earth.

11. A system for heating a liquid as set forth in claim 9, wherein:

said heat sink is a solar panel.

12. A system for heating a liquid as set forth in claim 9, further comprising:

controlled bypass means for re-routing at least a portion of the liquid directly into said condenser coil second passage inlet;

said bypass means controlled by a predetermined low pressure sensor for sensing refrigerant pressure in said evaporator coil first passage.

13. A system for heating a liquid as set forth in claim 8, further comprising:

a source of fluid;

controlled means for pumping said fluid over the exterior surface of said evaporator coil when said fluid temperature is warmer than said evaporator coil.

14. A system for heating a liquid as set forth in claim 8, further comprising:

refrigerant flow reversing means for controlled, re-routing of said compressed and heated refrigerant discharging from said refrigerant metering means into said evaporator coil first passage outlet, through said evaporator coil first passage, out said evaporator coil first passage inlet, and returning back to said compressor inlet.

15. A system for heating a liquid as set forth in claim 8, further comprising:

liquid flow reversing means for controlled, re-routing of the liquid into said evaporator coil second passage outlet, through said evaporator coil second passage, out said evaporator coil second passage inlet, and into said condenser coil second passage inlet.

16. A system for heating a liquid as set forth in claim 8, further comprising:

means for alternate, controlled cooling of the liquid including means for controlled diverting of at least a portion of the liquid discharging from said evaporator coil second passage outlet from entering said condenser second passage inlet.

17. A system for heating a liquid as set forth in claim 16, further comprising:

a source of fluid;

a controlled means for pumping the fluid over the exterior surface of said condenser coil when the fluid temperature is cooler than said condenser coil.

18. A system for heating liquids comprising:

first and second conduit means for conveying a first and second liquid therein respectively, substantially in fluid isolation one to another;

a source of refrigerant;

a refrigerant compressor having an inlet and an outlet, said compressor for compressing and heating said refrigerant and then discharging said heated and compressed refrigerant out said compressor outlet;

a condenser coil and an evaporator coil each having first and second segregated, adjacent fluid passages each having an inlet and an outlet;

said condenser coil first passage inlet for receiving said compressed, heated refrigerant from said compressor outlet, said compressed and heated refrigerant then passing through said condenser coil first passage and out said condenser coil first passage outlet;

said first conduit means conveying the first liquid into said condenser coil second passage inlet and through said condenser coil second passage in opposing heat exchange relationship to said heated and compressed refrigerant flowing through said condenser coil first passage whereby the first liquid is heated and said refrigerant and said condenser coil are cooled;

said first conduit means also conveying the heated first liquid exiting from said condenser coil second passage outlet;

first one-way means for predetermined, controlled metering of said compressed and cooled refrigerant discharging from said condenser coil first passage outlet into said evaporator coil first passage inlet whereby said refrigerant is vaporized and cooled at lower pressure within said evaporator coil first passage;

means for returning said refrigerant from said evaporator coil first passage outlet back to said compressor through said compressor inlet;

said second conduit means for conveying the second liquid into said evaporator coil second passage inlet and through said evaporator coil second passage in opposing heat exchange relationship to said vaporized and cooled refrigerant flowing through said evaporator coil first passage whereby the second liquid is cooled and said refrigerant and said evaporator coil are heated;

said second conduit means also conveying the cooled second liquid existing from said evaporator coil second passage outlet;

a source of fluid;

controlled means for pumping said fluid over the external surface of said evaporator coil when said fluid temperature is warmer than said evaporator coil.

19. A system for heating liquids as set forth in claim 18, wherein:

said fluid is air.

20. A system for heating liquids as set forth in claim 18, wherein:

said fluid is water.

21. A system for heating and cooling liquid comprising:

first and second liquid reservoirs each having a first and second liquid therein respectively, and each said reservoir substantially in fluid isolation one to another;

first and second liquid pump means each in fluid communication with, and, for pumping said first and second liquids from said first and said second liquid reservoirs respectively;

a source of refrigerant;

a refrigerant compressor having an inlet and an outlet, said compressor for compressing and heating said refrigerant and then discharging said heated and compressed refrigerant out said compressor outlet;

a condenser coil and an evaporator coil each having first and second colinear, segregated, adjacent fluid passages each having an inlet and an outlet;

said condenser coil first passage inlet for receiving said compressed, heated refrigerant from said compressor outlet, said compressed and heated refrigerant then passing through said condenser coil first passage and out said condenser coil first passage outlet;

said first liquid pumped from said first liquid reservoir by said first pump means into said condenser coil second passage inlet and through said condenser coil second passage in opposing heat exchange relationship to said heated and compressed refrigerant flowing through said condenser coil first passage whereby the first liquid is heated and said refrigerant and said condenser coil are cooled;

means for returning said first liquid exiting from said condenser coil second passage outlet;

first one-way means for predetermined, controlled metering of said compressed and cooled refrigerant discharging from said condenser coil first passage outlet into said evaporator coil first passage inlet whereby said refrigerant is vaporized and cooled at lower pressure within said evaporator coil first passage;

means for returning said refrigerant from said evaporator coil first passage outlet back to said compressor through said compressor inlet;

conduit means for conveying said second liquid pumped from said second liquid reservoir by said second pump means into said evaporator coil second passage inlet and through said evaporator coil second passage in opposing heat exchange relationship to said vaporized and cooled refrigerant flowing through said evaporator coil first passage whereby the second liquid is cooled and said refrigerant and said evaporator coil are heated;

means for returning said second liquid exiting said evaporator coil second passage outlet back to said reservoir;

refrigerant flow reversing means for controlled intermittent re-routing of said compressed and heated refrigerant discharging from said compressor outlet in seriatim first into said evaporator coil first passage outlet, then through said evaporator coil first passage whereby the second liquid flowing through said evaporator second passage is heated, then out said evaporator coil first passage inlet and through a second one-way means for predetermined metering of said compressed and cooled refrigerant, then into said condenser coil first passage outlet, then through said condenser coil first passage whereby the first liquid flowing through said condenser coil second passage is cooled, then out said condenser coil first passage inlet and then returning back to said compressor inlet.

22. A system for heating and cooling liquids comprising:

first and second liquid reservoirs each having a first and second liquid therein respectively, and each said reservoir substantially in fluid isolation one to another;

first and second liquid pump means each in fluid communication with, and, for pumping said first and second liquids from said first and second liquid reservoirs respectively;

a source of refrigerant;

a refrigerant compressor having an inlet and an outlet, said compressor for compressing and heating said refrigerant and then discharging said heated and compressed refrigerant out of said compressor outlet;

a condenser coil and an evaporator coil each having first and second colinear segregated, adjacent fluid passages each having an inlet and an outlet;

said condenser coil first passage inlet for receiving said compressed, heated refrigerant from said compressor outlet, said compressed and heated refrigerant then passing through said condenser coil first passage and out said condenser coil first passage outlet;

said first liquid pumped from said first liquid reservoir by said first pump means into said condenser coil second passage inlet and through said condenser coil second passage in opposing heat exchange relationship to said heated and compressed refrigerant flowing through said condenser coil first passage whereby the first liquid is heated and said refrigerant and said condenser coil are cooled;

means for returning said first liquid from said condenser coil second passage outlet to said first reservoir;

first one-way means for predetermined, controlled metering of said compressed and cooled refrigerant discharging from said condenser coil first passage outlet into said evaporator coil first passage inlet whereby said refrigerant is vaporized and cooled at lower pressure within said evaporator coil first passage;

means for returning said refrigerant from said evaporator coil first passage outlet back to said compressor through said compressor inlet;

conduit means for conveying said second liquid pumped from said second liquid reservoir by said second pump means into said evaporator coil second passage inlet and through said evaporator coil second passage in opposing heat exchange relationship to said vaporized and cooled refrigerant flowing through said evaporator coil first passage whereby the second liquid is cooled and said refrigerant and said evaporator coil are heated;

means for returning said second liquid exiting said evaporator coil second passage outlet back to said second reservoir;

a source of fluid;

controlled means for pumping said fluid over the exterior surface of said condenser coil when said fluid temperature is cooler than said condenser coil;

controlled means for pumping said fluid over the exterior surface of said evaporator coil when said fluid temperature is warmer than said evaporator coil.

23. A system for heating a liquid comprising:

a liquid reservoir having liquid therein;

a liquid pump means in fluid communication with, and, for pumping said liquid from said reservoir;

a source of refrigerant;

a refrigerant compressor having an inlet and an outlet, said compressor for compressing and heating said refrigerant and then discharging said heated and compressed refrigerant out said compressor outlet;

a condenser coil and an evaporator coil each having first and second colinear, segregated, adjacent fluid passages each having an inlet and an outlet;

said condenser coil first passage inlet for receiving said compressed, heated refrigerant from said compressor outlet, said compressed and heated refrigerant then passing through said condenser coil first passage and out said condenser coil first passage outlet;

one-way means for predetermined, controlled metering of said compressed and cooled refrigerant discharging from said condenser coil first passage outlet into said evaporator coil first passage inlet whereby said refrigerant is vaporized and cooled at lower pressure within said evaporator coil first passage;

conduit means for conveying said liquid pumped from said liquid reservoir by said pump means into said evaporator second passage inlet and through said evaporator coil second passage in opposing heat exchange relationship to said vaporized and cooled refrigerant flowing through said evaporator coil first passage whereby said liquid is cooled and said vaporized refrigerant and said evaporator coil are heated;

conduit means for conveying said liquid exiting from said evaporator coil second passage outlet into said condenser coil second passage inlet, through said condenser coil second passage in opposing heat exchange relationship to said heated and compressed refrigerant flowing through said condenser coil first passage whereby said liquid is heated and said refrigerant and said condenser coil are cooled;

means for returning said liquid exiting from said condenser second passage outlet back to said reservoir.

* * * * *